United States Patent [19]

Ridley et al.

[11] 4,120,354

[45] Oct. 17, 1978

[54] DETERMINING THE LOCUS OF A PROCESSING ZONE IN AN IN SITU OIL SHALE RETORT BY PRESSURE MONITORING

[75] Inventors: Richard D. Ridley; Robert S. Burton, III, both of Grand Junction, Colo.

[73] Assignee: Occidental Oil Shale, Inc., Grand Junction, Colo.

[21] Appl. No.: 803,363

[22] Filed: Jun. 3, 1977

[51] Int. Cl.[2] ..... E21B 43/24; E21B 47/06

[52] U.S. Cl. ..... 166/251; 166/252; 299/2

[58] Field of Search ..... 166/251, 250, 252, 259; 299/2, 4, 5

[56] References Cited

U.S. PATENT DOCUMENTS

| | | | |
|---|---|---|---|
| 2,481,051 | 9/1949 | Uren | 299/2 |
| 3,031,762 | 5/1962 | Parker | 166/251 X |
| 3,182,721 | 5/1965 | Hardy | 166/251 X |
| 3,586,377 | 6/1971 | Ellington | 166/259 X |
| 4,007,963 | 2/1977 | Ridley | 299/2 |

OTHER PUBLICATIONS van Poollen, "Transient Tests Find Fire Front in an In-Situ Combustion Project", The Oil and Gas Journal, vol. 63, No. 5, Feb. 1, 1965, pp. 78–80.

*Primary Examiner*—Stephen J. Novosad

*Attorney, Agent, or Firm*—Christie, Parker & Hale

[57] ABSTRACT

The locus of a processing zone advancing through a fragmented permeable mass of particles in an in situ oil shale retort in a subterranean formation containing oil shale is determined by monitoring pressure in the retort. Monitoring can be effected by placing a pressure transducer in a well extending through the formation adjacent the retort and/or in the fragmented mass such as in a well extending into the fragmented mass.

36 Claims, 2 Drawing Figures

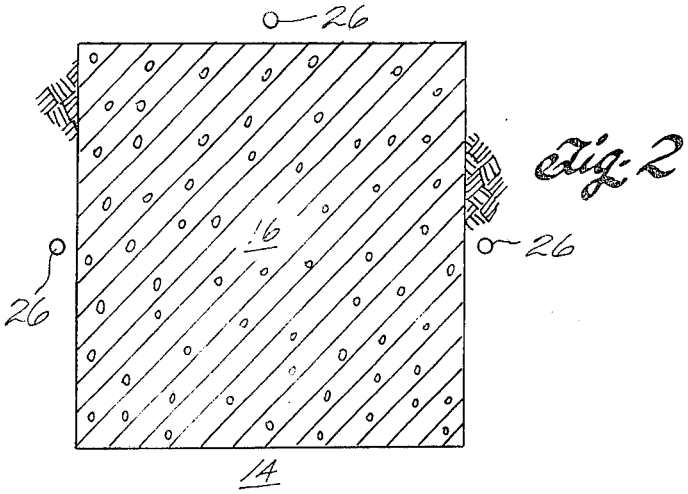
Fig. 2
Fig. 1
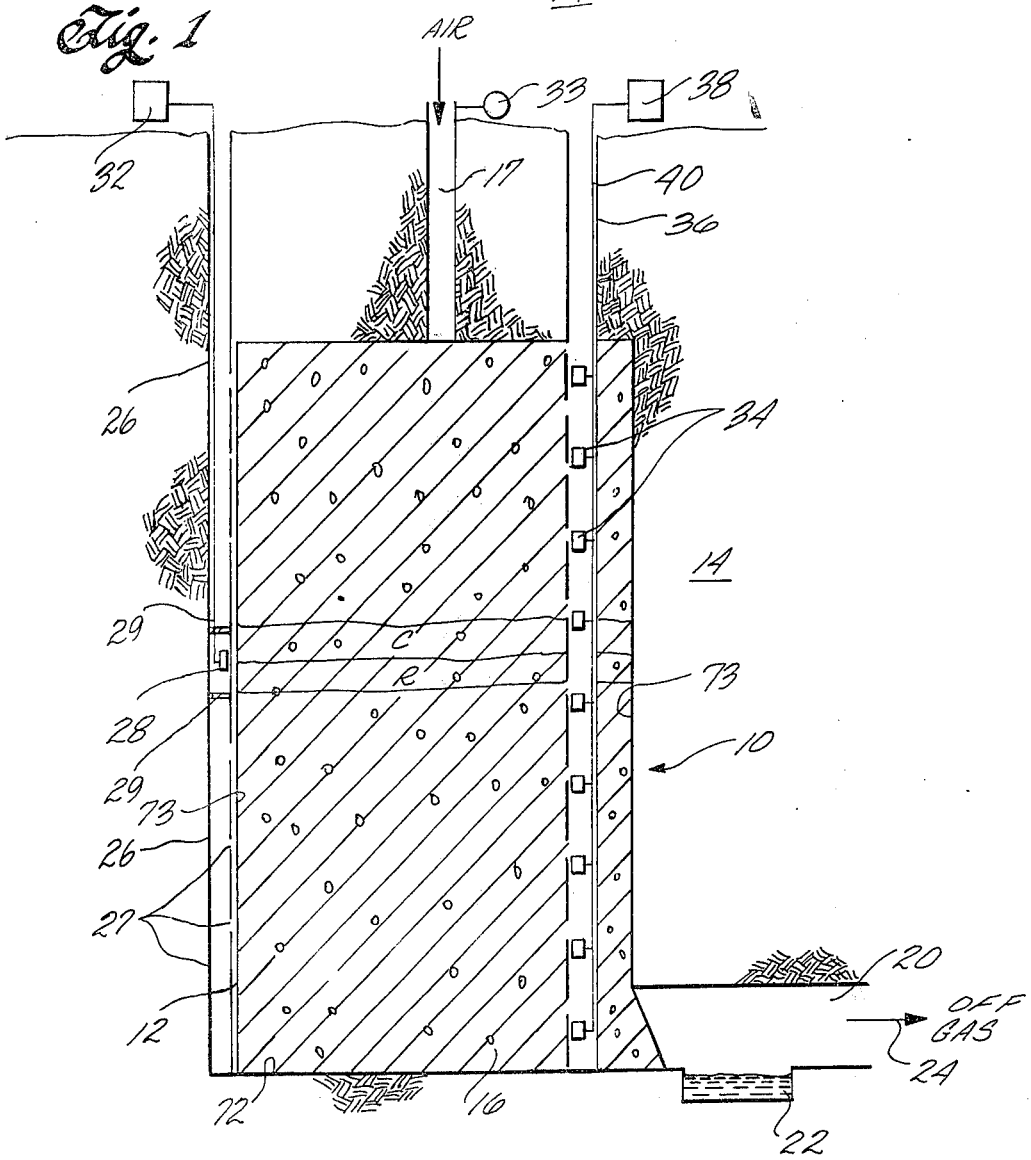

DETERMINING THE LOCUS OF A PROCESSING ZONE IN AN IN SITU OIL SHALE RETORT BY PRESSURE MONITORING

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen", which upon heating decomposes to produce liquid and gaseous hydrocarbon products. It is the formation containing kerogen that is called "oil shale" herein, and the liquid hydrocarbon product is called "shale oil".

A number of methods have been proposed for processing the oil shale which involve either first mining the kerogen bearing shale and processing the shale above ground, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972 to Donald E. Garrett, assigned to the assignee of this application, and incorporated herein by this reference. This patent describes in situ recovery of liquid and gaseous hydrocarbon materials from a subterranean formation by fragmenting such formation to form a stationary, fragmented, permeable mass of formation particles containing oil shale within the formation, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of a gaseous combustion zone feed comprising oxygen downwardly into the combustion zone to advance the combustion zone downwardly through the retort. In the combustion zone oxygen in the gaseous combustion zone feed is depleted by reaction with hot carbonaceous materials to produce heat and combustion gas. By the continued introduction of the combustion zone feed downwardly into the retort, the combustion zone is advanced downwardly through the retort.

The effluent gas from the combustion zone comprises combustion gas and any gaseous portion of the combustion zone feed that does not take part in the combustion process. This effluent gas is essentially free of free oxygen and contains constituents such as oxides of carbon and sulfurous compounds. It passes through the fragmented mass in the retort on the advancing side of the combustion zone to heat the oil shale in a retorting zone to a temperature sufficient to produce kerogen decomposition, called retorting, in the oil shale to gaseous and liquid hydrocarbon products and to a residue of solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort and withdrawn to the surface through an access tunnel, drift or shaft. An off gas containing combustion gas generated in the combustion zone, gaseous products produced in the retorting zone, gas from carbonate decomposition, and any gaseous portion of combustion zone feed that does not take part in the combustion process is also withdrawn from the bottom of the retort to the surface.

It is desirable to know the locus of parts of the combustion and retorting processing zones as they advance through an in situ oil shale retort for many reasons. One reason is that by knowing the locus of the combustion zone, steps can be taken to control the orientation of the advancing side of the combustion zone. It is desirable to maintain a combustion zone which is flat and uniformly transverse and preferably uniformly normal to the direction of its advancement. If the combustion zone is skewed relative to its direction of advancement, there is more tendency for oxygen present in the combustion zone to oxidize hydrocarbon products produced in the retorting zone, thereby reducing hydrocarbon yield. In addition, with a skewed combustion zone, more cracking of the hydrocarbon products can result. Monitoring the locus of the combustion zone provides information for control of the advancement of the combustion zone to maintain it flat and uniformly perpendicular to the direction of its advancement to obtain high yield of hydrocarbon products.

Another reason for monitoring the locus of the combustion zone is so that the composition of the combustion zone feed can be varied with variations in the kerogen content of the oil shale being retorted. If combustion zone feed containing too high a concentration of oxygen is introduced into a region of the retort containing oil shale having a high kerogen content, oxidation of carbonaceous material in the oil shale can generate so much heat that fusion of the oil shale can result. High temperatures also can cause excessive endothermic carbonate decomposition to carbon dioxide and dilution of the off gas from the retort, thereby lowering the heating value of the off gas. Layers in the fragmented mass are correlated with strata in the unfragmented formation because there is little vertical mixing between strata when explosively fragmenting formation to form a fragmented permeable mass of formation particles. Therefore, samples of various strata through the retort can be taken before initiating retorting of the oil shale and assays can be conducted to determine the kerogen content. Then, by monitoring the locus of the combustion zone as it advances through the retort, the composition of the combustion zone feed can be appropriately modified.

Another reason for monitoring the locus of the combustion and retorting processing zones as they advance through the retort is to monitor the performance of the retort to determine if sufficient shale oil is being produced for the amount of oil shale being retorted.

Also, by monitoring the locus of the combustion and retorting zones, it is possible to control the advancement of these two zones through the retort at an optimum rate. The rate of advancement of the combustion and retorting zones through the retort can be controlled by varying the flow rate and composition of the combustion zone feed. Knowledge of the locus of the combustion and retorting zones allows optimization of the rate of advancement to produce hydrocarbon products of the lowest cost possible with cognizance of the overall yield, fixed costs, and variable costs of producing the hydrocarbon products.

Thus, it is desirable to provide a method for monitoring advancement of combustion and retorting processing zones through an in situ oil shale retort.

SUMMARY OF THE INVENTION

The present invention concerns a process for determining the locus of a processing zone such as a combustion zone advancing through a fragmented permeable mass of particles in an in situ oil shale retort in a subterranean formation containing oil shale. The method comprises the step of monitoring pressure in the retort.

Monitoring can be effected by placing a pressure transducer or a pressure tap in a conduit in fluid communication with the fragmented mass extending into the fragmented mass and/or in a well extending through unfragmented formation adjacent the retort and in fluid communication with the retort at selected locations along the length of the well. Also, a pressure transducer can be placed directly into the fragmented mass. A plurality of pressure transducers placed at a plurality of selected locations spaced apart from each other can be used. Preferably such pressure transducers are vertically spaced apart from each other for monitoring the locus of a processing zone advancing downwardly through the retort.

The pressure transducers are sensitive to pressure at various locations in a retort, and thus can be used for determining the pressure drop across various portions of a retort. The transducers are useful for distinguishing a combustion zone and a retorting zone from each other and from other portions of an in situ oil shale retort. Monitoring pressure in a retort provides a way of determining the locus of a processing zone in an in situ oil shale retort.

DRAWINGS

These and other features, aspects and advantages of the present invention will become more apparent upon consideration of the following description, appended claims and accompanying drawings where:

FIG. 1 schematically represents in vertical cross section an in situ oil shale retort having means for monitoring pressure in the retort; and FIG. 2 schematically represents in horizontal cross section an in situ oil shale retort having means for monitoring pressure in the retort.

DESCRIPTION

Referring to FIG. 1, an in situ oil shale retort 10 is in the form of a cavity 12 formed in an unfragmented subterranean formation 14 containing oil shale and having top 71, bottom 72, and side boundaries 73 of unfragmented formation. The cavity 12 contains a fragmented permeable mass 16 of formation particles containing oil shale. The cavity 12 can be created simultaneously with fragmentation of the mass of formation particles 16 by blasting by any of a variety of techniques. A desirable technique involves excavating one or more voids within the in situ oil shale retort site and explosively expanding remaining oil shale in the site toward such a void. A method of forming an in situ oil shale retort is described in U.S. Pat. No. 3,661,423. A variety of other techniques can also be used.

Sufficient formation is excavated in the retort site that the void fraction of the permeable mass is from about 10% to about 25%. As used herein, "void fraction" refers to the ratio of the volume of the voids or spaces between particles in the fragmented mass to the total volume of the fragmented permeable mass of particles in the in situ retort 10.

A conduit 17 communicates with the top of the fragmented mass of formation particles. During the retorting operation of the retort 10, a combustion processing zone C is established in the retort and advanced by introducing a retort inlet mixture containing an oxygen supplying gas, such as air or air mixed with other gases, into the in situ oil shale retort through the conduit 17 as a combustion zone feed. Oxygen from the retort inlet mixture introduced to the retort oxidizes carbonaceous material in the oil shale to produce combustion gas. Heat from the exothermic oxidation reactions, carried by flowing gases, advances the combustion zone through the fragmented mass of particles.

Combustion gas produced in the combustion zone and any gaseous unreacted portion of the combustion zone feed pass through the fragmented mass of particles on the advancing side of the combustion zone to establish a retorting processing zone R on the advancing side of the combustion zone. Kerogen in the oil shale is retorted in the retorting zone to produce liquid and gaseous products.

There is an access tunnel, adit, drift 20 or the like in communication with the bottom of the retort. The drift contains a sump 22 in which liquid products are collected to be withdrawn for further processing. An off gas 24 containing gaseous products, combustion gas, gas from carbonate decomposition, and any gaseous unreacted portion of the combustion zone feed is also withdrawn from the in situ oil shale retort 10 by way of the drift 20.

The retort inlet mixture can be introduced to the retort under pressure from gas transfer means such as a blower (not shown). Alternatively, gas withdrawing means such as a blower (not shown) can be used to withdraw off gas 24 from the retort and thereby create pressure less than ambient pressure throughout the retort to cause air 18 or other gaseous source of oxygen to enter the retort through conduit 17. Also, gas pumping means for introducing the oxygen supplying gas and gas withdrawing means for withdrawing the off gas can be used in combination.

The pressure differential from the top to bottom for vertical movement of gas down through the retort depends upon various parameters of the retort and retorting process such as lithostatic pressure, void fraction of the fragmented mass, permeability of the fragmented mass, particle size in the fragmented mass, the temperature pattern of the retorting and combustion zones, gas volumetric flow rates, grade of oil shale being retorted, rate of heating of the fragmented mass, gas composition, gas generation from mineral decomposition and the like. For example, an in situ retort having about 20% void fraction and a height of 100 feet can have a pressure differential less than about 1 psi from top to bottom for vertical movement of gas down through the retort at about 1 scfm (standard cubic foot per minute) per square foot of horizontal cross section of the fragmented mass. Retorts having greater heights have proportionately larger pressure drops. Thus, an adequate gas flow rate through retorts up to 1000 feet in height can be provided with a pressure differential of less than about 10 psi from top to bottom.

Papers relating permeability of a fragmented permeable mass of formation particles containing oil shale to various retort and retorting process parameters include "Prediction of the Permeability of a Fragmented Oil Shale Bed During In Situ Retorting With Hot Gas," by R. B. Needham, Paper No. SPE 6071, presented at 1976 Fall Technical Conference and Exhibition of the Society of Petroleum Engineers of AIME; "Some Effects of Overburden Pressure on Oil Shale During Underground Retorting," by G. W. Thomas, Paper presented at Society of Petroleum Engineers 1965 Annual Fall Meeting; "Structural Deformation of Green River Oil Shale as It Relates to In Situ Retorting," by P. R. Tisot and H. W. Sohns, (Washington) U.S. Department of Interior, Bureau of Mines (1971); and "Permeability Changes and Compaction of Broken Oil Shale During Retorting," by Edward L. Burwell, Samuel S. Tihen and Harold W. Sohns, (Washington) U.S. Bureau of Mines (1974). Each of these papers is incorporated herein by this reference and a copy of each of these papers accompanies this application. These papers indicate that the permeability of a fragmented permeable mass of oil shale particles tends to decrease and thus pressure drop across the fragmented mass tends to increase as overburden pressure increases, as grade of oil shale being retorted increases, as the temperature of the fragmented mass increases up to 800° F, and as the average particle size of the fragmented mass decreases.

During the retorting operation the pressure at selected locations in the fragmented mass and the pressure gradient across selected portions of the fragmented mass change with time as the retorting and combustion processing zones advance through the fragmented mass. In addition, the pressure gradient across different portions of the fragmented mass can be different from each other. These phenomena can be the result of the fragmented permeable mass of particles 16 undergoing thermal stresses due to temperature changes during the retorting operation. Initially the particles in the fragmented mass are at ambient temperature. The particles are gradually heated to the temperature of the retorting zone, which can be as high as about 1100° F, and eventually the particles attain the temperature of the combustion zone, which can be up to the fusion temperature of oil shale, which is about 2100° F, although it is preferably appreciably lower. Subsequently, as the combustion zone further advances through the retort beyond the particles, the particles are cooled by the retort inlet mixture.

This heating of the particles as the retorting and combustion zones approach causes swelling of the particles. Part of this swelling is temporary and results from thermal expansion, and part is permanent and is believed to be brought about by the retorting of kerogen in the shale. As the particles subsequently cool after the combustion zone has passed, the particles decrease in size from thermal contraction. The thermal swelling of particles in the retorting and combustion processing zones can diminish the size of spaces between particles thereby decreasing the effective void fraction and the permeability of the fragmented mass. The smaller cross-sectional area available for gas flow is manifested by increased pressure gradient across the hotter portions of the fragmented mass, and particularly the combustion zone.

Another phenomenon which can affect pressure at selected locations in the fragmented mass and the pressure gradient across selected portions of the fragmented mass in a retort is a decrease in average particle size in the fragmented mass due to thermally induced disintegration of particles. As noted above, pressure gradient across the fragmented mass tends to increase with a decrease in average particle size.

Also contributing to changes in pressure gradient in the retort during retorting of oil shale can be a decrease in the effective void fraction of the fragmented mass due to absorption of liquid hydrocarbons on the surface of oil shale in the retorting zone and on the advancing side of the retorting side. This tends to increase the pressure gradient in the retort in the retorting zone and on the advancing side of the retorting zone.

Other phenomena occurring in the retorting and combustion zones which can affect the pressure gradient in the fragmented mass include release of volatilized hydrocarbons by decomposition of kerogen in the oil shale and release of carbon dioxide due to decomposition of alkaline earth metal carbonates such as calcium and magnesium carbonates present in oil shale. These thermally induced reactions increase the mass flow rate of gases on the advancing side of and in the retorting and combustion zones. This tends to increase the volumetric flow rate of the gases on the advancing side of and in the retorting and combustion zones which tends to increase the pressure gradient across the retorting and combustion zones. In addition, the volume and viscosity of gases increase as their temperature increases. Therefore, heating of gases in the region of the retorting and combustion zones increases their viscosity and increases their volumetric flow rate, and thereby increases the pressure gradient across the retorting and combustion zones of the retort. Condensation of volatilized hydrocarbons and water vapor on the advancing side of the retorting zone decreases the volumetric flow rate of gases on the advancing side of the retorting zone, which tends to decrease the pressure gradient across the fragmented mass on the advancing side of the retorting zone.

Since the combustion zone is the hottest region of the retort, and thereby can have the hottest gases flowing therethrough with the highest volumetric flow rate, it can be expected that the combustion zone has the highest pressure gradient in the retort.

Since the retorting zone is the second hottest region of the retort, it thereby can have the second hottest gases flowing therethrough, and since the bulk of the gaseous products produced in the retort are produced in the retorting zone, it can be expected that the retorting zone has the second highest pressure gradient in the retort.

As used herein, pressure gradient refers to the change of pressure experienced by gas passing through the fragmented mass per foot of thickness of the fragmented permeable mass.

Therefore, in practice of this invention the locus of a combustion zone C and/or a retorting zone R advancing through the fragmented permeable mass of particles is determined by monitoring the pressure in the fragmented mass in the retort to monitor (1) changes in pressure gradient with time across selected portions of the fragmented mass as retorting progresses; (2) changes in the pressure at selected locations in the fragmented mass with time as retorting progresses; and/or (3) differences between the pressure gradient across different portions of the fragmented mass at a selected time. Monitoring can be effected by placing one or more pressure taps or pressure transducers in and/or adjacent to the retort at selected locations.

For example, referring to FIG. 1, in a first version of this invention a well such as an uncased bore hole or casing 26 perforated at selected locations along its length extends vertically through the formation 14 adjacent the fragmented permeable mass 16 in the retort along a side boundary 73 of the retort. Because of the perforations 27 through the casing 26 and permeability of the formation 14, the interior of the casing 26 is in fluid communication with the retort. The formation can have sufficient natural permeability to provide fluid communication between the fragmented mass and the casing 26. Also, fractures induced in the subterranean formation adjacent the retort when blasting to form the fragmented mass can provided fluid communication between the interior of the casing 26 and the retort. Also, formation between the casing 26 and the fragmented mass can be artificially fractured such as by hydro-fracturing. Therefore the pressure along the length of the casing can correspond to the pressure along the length of the retort.

Within the well is a pressure transducer 28 above and below which are packings 29 so that the pressure at a selected elevation in the well can be isolated. The transducer, which converts pressure to an electrical output, is connected to an electrical signal means such as a signal lead cable 30 connected to monitoring means 32 such as a recorder or indicator at an accessible location in underground workings or above ground.

Means 33 for determining the inlet pressure of the retort inlet mixture is provided. The inlet pressure of the retort inlet mixture is substantially the same as the pressure at the top of the fragmented mass. Therefore, the pressure gradient of gas flowing from the top of the fragmented mass to a location in the fragmented mass adjacent a transducer 28 can be determined.

The locus of the combustion and/or retorting zones can be monitored by noting signals from the transducer 28 to determine changes in pressure gradient across selected portions of the retort. For example, at a constant inlet pressure of the retort inlet mixture, when the pressure measured with the pressure transducer 28 increases, this indicates that gases passing through that portion of the fragmented mass adjacent the transducer 28 are undergoing increased pressure gradient and therefore the retorting and combustion zones are approaching. When the pressure monitored by the transducer 28 reaches a maximum relative to the inlet pressure of the retort inlet mixture, this indicates that the combustion zone is adjacent the transducer 28. Conversely, as the pressure being monitored with the transducer 28 decreases at a constant inlet pressure of the retort inlet mixture, this indicates that the combustion and retorting zones are receding from the portion of the retort adjacent the pressure transducer 28.

The pressure transducer can be a device such as an electrical pressure transducer of the strain gauge type or piezoelectric type, a mechanical strain gauge such as a Bourdon gauge, and the like.

If only one stationary pressure transducer is used in the well, the location of a processing zone not proximate to the transducer can only be approximated. However, with a movable transducer, the transducer and packings can be moved through the well to scan pressure at different elevations to accurately determine the locus of a processing zone in the retort. Similarly, with a plurality of transducers at different elevations in the well, the locus of a processing zone can be accurately determined.

Preferably the well or bore hole 26 is drilled or otherwise provided through unfragmented formation 14 at a distance of from about 4 to about 8 feet from the fragmented mass 16 in the retort 10. At a distance greater than about 8 feet, the pressure in the bore hole may not correspond to pressure along the length of the retort because of insufficient fluid communication between the bore hole and the retort. Because of imprecision in accurately drilling bore holes and because of variations and irregularities in the wall of a retort, a bore hole is preferably at least about 4 feet from the fragmented mass in the retort to avoid drilling into the fragmented permeable mass when preparing the bore hole.

Also shown in FIG. 1 is a second version of this invention in which a plurality of vertically spaced apart pressure transducers 34 are in a conduit such as a perforated casing 36 extending into the fragmented permeable mass 16 of formation particles. The bore hole need not be cased in some embodiments. Packers can be used between the pressure transducers so the pressure at selected elevations in the casing can be isolated. These transducers are connected to monitoring means 38 above ground level by a multi-signal lead cable 40 extending through the well. An advantage of using a well or conduit extending into the fragmented mass is that the transducers can be placed within the retort, thereby permitting increased sensitivity to the pressure in different portions of the retort. When the transducers are in the fragmented permeable mass, it is necessary that the conduit, transducers, and leads be made of materials resistant to conditions in the retort. Such materials require resistance to high temperatures of the combustion zone and resistance to chemical attack by corrosive components of the gases present in the retort such as hydrogen sulfide and other sulfurous compounds.

An advantage of the first version of this invention where one or more pressure transducers are provided in a bore hole 26 adjacent the retort which does not extend into the fragmented mass is that a low cost conduit or casing formed from low performance materials such as carbon steel can be used. This is because the high temperature, corrosive environment present in the retort is not present to the same degree in the formation adjacent the retort. Also, the transducers and leads are not exposed to the corrosive environment in the retort. The instrument well adjacent the retort is preferred to avoid these conditions.

Preferably the wells 26, 40 are provided after blasting to form the cavity 12 and fragmented mass 16 to prevent closure during blasting of the bore holes into which the transducers are placed.

As an alternative to placing the pressure transducers in a cased bore hole in the fragmented mass, transducers without a protective casing can be used. This can be effected by pulling the casing or by placing transducers within the boundaries of a retort to be formed prior to explosively expanding formation to form the fragmented mass. Such transducers must be able to survive such explosive expansion of formation.

Preferably the pressure in the retort is monitored at at least two locations spaced apart from each other in a plane substantially normal to the direction of advancement of a processing zone being monitored. That is, in the case of a processing zone advancing downwardly through a retort, preferably pressure in the retort is monitored at at least two locations spaced apart from each other at a selected elevation. This permits determination of whether a processing zone advancing through a fragmented permeable mass is flat and uniformly transverse to its direction of advancement. If pressure transducers at a selected elevation register different pressures, this indicates that the processing zone is skewed and/or warped. If pressure transducers at the same elevation register substantially the same pressure, this indicates that the processing zone is uniformly normal to its direction of advancement.

More preferably the pressure in the retort is monitored at at least three locations spaced apart from each other in a plane substantially normal to the direction of advancement of a processing zone because, according to geometrical principles, three points are required to define a plane. Use of only two transducers may not provide enough information to determine that a processing zone is skewed.

To provide at least two, and more preferably three transducers in a plane substantially normal to the direction of advancement of a processing zone for monitoring pressure in two or more locations in the retort, preferably at least two, and more preferably at least three bore holes are provided for monitoring pressure. The bore holes can be spaced laterally apart within the fragmented mass, and/or as shown in FIG. 2, the bore holes 26 can be spaced apart around the perimeter of the fragmented mass.

As shown in FIG. 1, preferably the pressure in the retort is monitored at a plurality of selected locations spaced apart from each other along the direction of advancement of a processing zone through the fragmented mass such as by providing a plurality of transducers 34 spaced apart from each other along the direction of advancement of the processing zone or by moving transducers. This permits tracking of the processing zone as it advances through the fragmented mass. When a processing zone is advancing downwardly or upwardly through the fragmented mass, pressure transducers vertically spaced apart from each other can be provided.

Pressure in the retort can be monitored at selected locations spaced apart from each other along the direction of advancement of a processing zone and in a plane normal to the direction of advancement of a processing zone in combination for determining if a processing zone is skewed and/or warped throughout the retorting process.

When a plurality of vertically spaced apart transducers are hundreds in a single bore hole, it is preferred that the spacing between the transducers, and packers if used, be no more than about the minimum thickness of the processing zone being monitored. This is to allow accurate determination of the locus of the processing zone as it advances downwardly through a retort. However, when advancing a combustion zone through oil shale having a high kerogen content, the combustion zone can be as narrow as 1 to 2 feet. In such a situation, providing transducers spaced apart at a distance from 1 to 2 feet for a retort which has a depth of hundred of feet can be prohibitively expensive. If desired, useful data can be provided by spacing the transducers at a distance apart up to about 5 times the minimum thickness of an established combustion zone.

Monitoring the locus of the combustion zone C advancing through the fragmented permeable mass 16 in the retort 10 has significant advantages. For example, steps can be taken to maintain the combustion zone flat and uniformly normal to the direction of its advancement to minimize oxidation and excessive cracking of hydrocarbons produced in the retorting zone. In addition, the rate of introduction and composition of the oxygen containing gas introduced into the combustion zone can be controlled to maintain the temperature in the combustion zone sufficiently low to avoid formation of excessive amounts of carbon dioxide and to prevent fusion of the oil shale. Furthermore, knowledge of the locus of the combustion and retorting zones as they advance through the retort allows monitoring the performance of a retort. Knowledge of the locus of the combustion and retorting zones also allows optimization of the rate of advancement to produce hydrocarbon products with the lowest expense possible by varying the composition of and introduction rate of the retort inlet mixture.

Instead of using pressure transducers, pressure taps can be used for determining the pressure in the fragmented mass. For example, a perforated pipe can be placed in a retort from ground level and stainless steel tubing connected to a manometer at ground level can be placed into the pipe. The tubing can then be moved vertically in the perforated pipe to monitor the pressure at selected locations in the retort.

Although this invention has been described in considerable detail with reference to certain versions thereof, other versions of this invention can be practiced. For example, although the invention has been described in terms of an in situ oil shale retort containing both a combustion processing zone and a retorting processing zone, it is possible to practice this invention with a retort containing only one processing zone, either a combustion or retorting zone. In addition, although FIG. 1 shows a retort where the combustion and retorting zones are advancing downwardly through the retort, this invention is also useful for retorts where the combustion and retorting zones are advancing upwardly or transverse to the vertical.

Because of variations such as these, the spirit and scope of the appended claims should not be limited to the description of the preferred versions contained herein.

What is claimed is:

1. In a method for recovering gaseous and liquid products from an in situ oil shale retort in a subterranean formation containing oil shale, the in situ retort containing a fragmented permeable mass of particles containing oil shale and having a combustion processing zone and a retorting processing zone advancing therethrough, wherein the method comprises the steps of:

introducing into the in situ oil shale retort on the trailing side of the combustion processing zone a combustion zone feed comprising oxygen to advance the combustion processing zone through the fragmented mass of particles and produce combustion gas in the combustion processing zone;

passing said combustion gas and any gaseous unreacted portion of the combustion zone feed through a retorting processing zone in the fragmented mass of particles on the advancing side of the combustion processing zone, wherein oil shale is retorted and gaseous and liquid products are produced;

withdrawing liquid products and a retort off gas comprising said gaseous products, combustion gas and any gaseous unreacted portion of the combustion zone feed from the in situ oil shale retort from the advancing side of the retorting processing zone;

the improvement comprising determining the locus of a processing zone by the steps of (i) placing a plurality of pressure transducers at a plurality of locations vertically spaced apart from each other for monitoring pressure in the fragmented mass at a plurality of locations vertically spaced apart from each other, and (ii) monitoring signals emitted by the transducers.

2. A method for determining the locus of a processing zone advancing through a fragmented permeable mass of particles in an in situ oil shale retort in a subterranean formation containing oil shale, the method comprising the step of monitoring pressure in the fragmented mass at at least two locations spaced apart from each other in the direction of advancement of the processing zone.

3. A method as claimed in claim 2 in which the processing zone is a combustion zone and the step of monitoring comprises locating the portion of the fragmented mass having the highest pressure gradient.

4. A method as claimed in claim 2 including the step of placing a pressure transducer in a conduit extending into the fragmented mass and in fluid communication with the fragmented mass for monitoring pressure in the fragmented mass.

5. A method as claimed in claim 2 in which the step of monitoring includes placing a pressure transducer in a well in fluid communication with the retort along the length of the well and extending through unfragmented formation adjacent the fragmented mass for monitoring pressure in the fragmented mass.

6. A method as claimed in claim 2 in which the processing zone advances downwardly through the fragmented mass and the step of monitoring comprises monitoring pressure in the fragmented mass at a plurality of locations vertically spaced apart from each other.

7. A method for determining the locus of a processing zone advancing through a fragmented permeable mass of particles in an in situ oil shale retort in a subterranean formation containing oil shale, the method comprising the step of monitoring pressure in the fragmented mass at at least two locations spaced apart from each other in a plane substantially normal to the direction of advancement of the processing zone.

8. The method of claim 7 in which the step of monitoring comprises monitoring pressure in the fragmented mass at at least three locations spaced apart from each other in a plane substantially normal to the direction of advancement of the processing zone.

9. A method as claimed in claim 8 including the step of placing a pressure transducer in each of three conduits extending into the fragmented mass for monitoring the pressure in the fragmented mass.

10. A method as claimed in claim 8 including the step of placing a pressure transducer in each of three wells extending through unfragmented formation adjacent the fragmented mass and in fluid communication with the fragmented mass for monitoring pressure in the retort.

11. A method as claimed in claim 8 including the step of placing a pressure tap in each of three conduits extending into the fragmented mass for monitoring the pressure in the fragmented mass.

12. A method as claimed in claim 7 in which the step of monitoring comprises moving a pressure transducer to a plurality of locations spaced apart from each other along the direction of advancement of the processing zone.

13. A method as claimed in claim 12 in which the pressure transducer is moved in a well extending through unfragmented formation adjacent the fragmented mass and in fluid communication with the retort at selected locations along the length of the well.

14. A method as claimed in claim 7 in which the step of monitoring comprises monitoring pressure in the fragmented mass at a plurality of locations spaced apart from each other along the direction of advancement of the processing zone.

15. A method as claimed in claim 7 in which the processing zone is a combustion zone and the step of monitoring comprises locating the portion of the fragmented mass having the highest pressure gradient.

16. A method for determining the locus of a processing zone advancing through a fragmented permeable mass of particles in a subterranean formation containing oil shale, the method comprising the steps of:

drilling at least one bore hole extending through unfragmented formation adjacent the fragmented mass and in fluid communication with the fragmented mass; and monitoring pressure in the fragmented mass from within the bore hole.

17. A method as claimed in claim 16 in which the processing zone advances downwardly through the fragmented mass and the step of drilling comprises drilling at least three substantially vertical bore holes extending through unfragmented formation adjacent the fragmented mass and the step of monitoring comprises moving a pressure transducer within each bore hole to a plurality of locations vertically spaced apart from each other.

18. A method as claimed in claim 16 in which the step of drilling comprises drilling at least one bore hole extending through unfragmented formation adjacent the fragmented mass in the direction of advancement of the processing zone, and the step of monitoring comprises monitoring pressure in the fragmented mass within the bore hole at a plurality of locations spaced apart from each other.

19. A method as claimed in claim 16 in which the step of drilling comprises drilling at least one bore hole extending through unfragmented formation adjacent the fragmented mass in the direction of advancement of the processing zone, and the step of monitoring comprises moving a pressure transducer within the bore hole to a plurality of locations vertically spaced apart from each other.

20. A method as claimed in claim 16 in which the processing zone is a combustion zone and the step of monitoring comprises locating the portion of the fragmented mass having the highest pressure gradient.

21. A method for determining the locus of a processing zone advancing through a fragmented permeable mass of particles in a subterranean formation containing oil shale, the mass having a gas inlet and a gas outlet, the method comprising the steps of:

providing at least one cased bore hole extending into the fragmented mass at a location between the gas inlet and the gas outlet; and monitoring within such a bore hole for pressure in the fragmented mass at a location between the gas inlet and the gas outlet.

22. A method as claimed in claim 21 in which the processing zone advances downwardly through the retort and the step of monitoring comprises moving a pressure transducer in such a bore hole to a plurality of locations vertically spaced apart from each other.

23. A method as claimed in claim 21 in which the processing zone is a combustion zone and the step of monitoring comprises locating the portion of the fragmented mass having the highest pressure gradient.

24. A method for determining the locus of a processing zone advancing downwardly through a fragmented permeable mass of particles in an in situ oil shale retort in a subterranean formation containing oil shale, the method comprising the step of monitoring pressure in the fragmented mass at at least three locations spaced apart from each other at substantially the same elevation.

25. A method for determining the locus of a processing zone advancing through an in situ oil shale retort containing a fragmented permeable mass of particles in a subterranean formation containing oil shale, the method comprising the steps of:

drilling at least three bore holes spaced apart from each other extending through unfragmented formation adjacent the fragmented mass; and monitoring pressure in the retort at a location within each of the bore holes in a plane substantially normal to the direction of advancement of the processing zone.

26. A method for determining the locus of a processing zone advancing through a fragmented permeable mass of particles in an in situ oil shale retort in a subterranean formation containing oil shale, gas being introduced to the retort at a gas inlet and gas being withdrawn from the retort at a gas outlet, the method comprising the step of determining pressure in the fragmented mass at at least two locations spaced apart from each other in the direction of advancement of the processing zone, the locations being between the gas inlet and the gas outlet.

27. A method as claimed in claim 26 in which the processing zone is a combustion zone and the step of monitoring comprises locating the portion of the fragmented mass having the highest pressure gradient.

28. A method as claimed in claim 26 including the step of placing a pressure transducer in a conduit extending into the fragmented mass and in fluid communication with the fragmented mass for monitoring pressure in the fragmented mass.

29. A method as claimed in claim 26 in which the step of monitoring includes placing a pressure transducer in a well in fluid communication with the retort along the length of the well and extending through unfragmented formation adjacent the fragmented mass for monitoring pressure in the fragmented mass.

30. A method as claimed in 26 in which the processing zone advances downwardly through the fragmented mass and the step of monitoring comprises monitoring pressure in the fragmented mass at a plurality of locations vertically spaced apart from each other.

31. A method as claimed in claim 26 in which the inlet pressure of gas being introduced to the retort at the gas inlet is maintained substantially constant.

32. A method for determining the locus of a processing zone advancing through a fragmented permeable mass of particles in an in situ oil shale retort in a subterranean formation containing oil shale, gas being introduced to the retort at a gas inlet and gas being withdrawn from the retort at a gas outlet, the method comprising the step of monitoring pressure in the fragmented mass at at least two locations spaced apart from each other in a plane substantially normal to the direction of advancement of the processing zone, the locations being between the gas inlet and the gas outlet.

33. A method as claimed in claim 32 in which the step of monitoring comprises moving a pressure transducer to a plurality of locations spaced apart from each other along the direction of advancement of the processing zone.

34. A method as claimed in claim 33 in which the pressure transducer is moved in a well extending through unfragmented formation adjacent the fragmented mass and in fluid communication with the retort at selected locations along the length of the well.

35. A method as claimed in claim 32 in which the step of monitoring comprises monitoring pressure in the fragmented mass at a plurality of locations spaced apart from each other along the direction of advancement of the processing zone, the locations being between the gas inlet and the gas outlet.

36. A method as claimed in claim 32 in which the inlet pressure of gas being introduced to the retort at the gas inlet is maintained substantially constant.

* * * * *